US007427107B2

(12) United States Patent
Yang

(10) Patent No.: US 7,427,107 B2
(45) Date of Patent: Sep. 23, 2008

(54) MOVABLE BACKREST FOR A CHAIR

(76) Inventor: Po Hsuan Yang, No. 137, Anning Street, Annan District, Tainan City (TW) 70957

( * ) Notice: Subject to any disclaimer, the term of this patent is extended or adjusted under 35 U.S.C. 154(b) by 0 days.

(21) Appl. No.: 11/502,171

(22) Filed: Aug. 10, 2006

(65) Prior Publication Data

US 2008/0036261 A1 Feb. 14, 2008

(51) Int. Cl.
*A47C 7/40* (2006.01)

(52) U.S. Cl. ..... 297/354.11; 297/291; 297/452.33

(58) Field of Classification Search ..... 297/354.11, 297/291–293, 299, 353, 452.33, 440.2
See application file for complete search history.

(56) References Cited

U.S. PATENT DOCUMENTS 1,011,026 A * 12/1911 Carpenter ..... 297/452.29
2,796,920 A * 6/1957 Cowles ..... 297/291
3,054,643 A * 9/1962 Militano ..... 297/440.2
3,861,747 A * 1/1975 Diamond ..... 297/452.49
3,934,930 A * 1/1976 Sandham ..... 297/291
4,135,836 A * 1/1979 Rensland et al. ..... 297/291
4,880,276 A * 11/1989 Shovar ..... 297/452.2
5,195,804 A * 3/1993 Stolle et al. ..... 297/452.33
5,904,397 A * 5/1999 Fismen ..... 297/291
6,116,687 A * 9/2000 Vogtherr ..... 297/300.1
6,406,096 B1 * 6/2002 Barile, Sr. ..... 297/301.3
6,523,895 B1 * 2/2003 Vogtherr ..... 297/300.1
7,063,384 B2 * 6/2006 Liu ..... 297/284.4

* cited by examiner

*Primary Examiner*—Peter R. Brown
(74) *Attorney, Agent, or Firm*—Pro-Techtor Int'l Services

(57) ABSTRACT

A movable backrest for a chair comprises a frame that is fixed to the chair, at least a flexible connecting element connected to the frame, and at least a backrest connected to the connecting element. Since the connecting element is flexible, the backrest and the back of the user can be moved simultaneously along with the movement of the back of the user, providing a comfortable support to the back of the user.

3 Claims, 8 Drawing Sheets

MOVABLE BACKREST FOR A CHAIR

BACKGROUND OF THE INVENTION

1. Field of the Invention

The present invention relates to a movable backrest for a chair, and more particularly to a movable backrest for a chair, wherein a backrest and the back of the user can be moved simultaneously along with the movement of the back of the user.

2. Description of the Prior Art

A conventional backrest for a chair is unmovable, when the user sits on the chair, the back of the user is abutted against the backrest and repressed by the backrest, so the user will feel uncomfortable.

The present invention has arisen to mitigate and/or obviate the afore-described disadvantages.

SUMMARY OF THE INVENTION

The primary objective of the present invention is to provide a movable backrest for a chair comprises a frame fixed to the chair, at least a connecting element that connected to the frame which is flexible, and at least a backrest connected to the connecting element, thus the backrest is movable.

A space is formed between the backrest and the connecting element so as to increase the flexibility of the connecting element.

The frame includes at least a protruded portion serves to engage with a concave portion of the connecting element, and a flange is formed on the protruded portion. When the concave portion is engaged with the protruded portion, the backrest is faced to the inner side of the chair.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
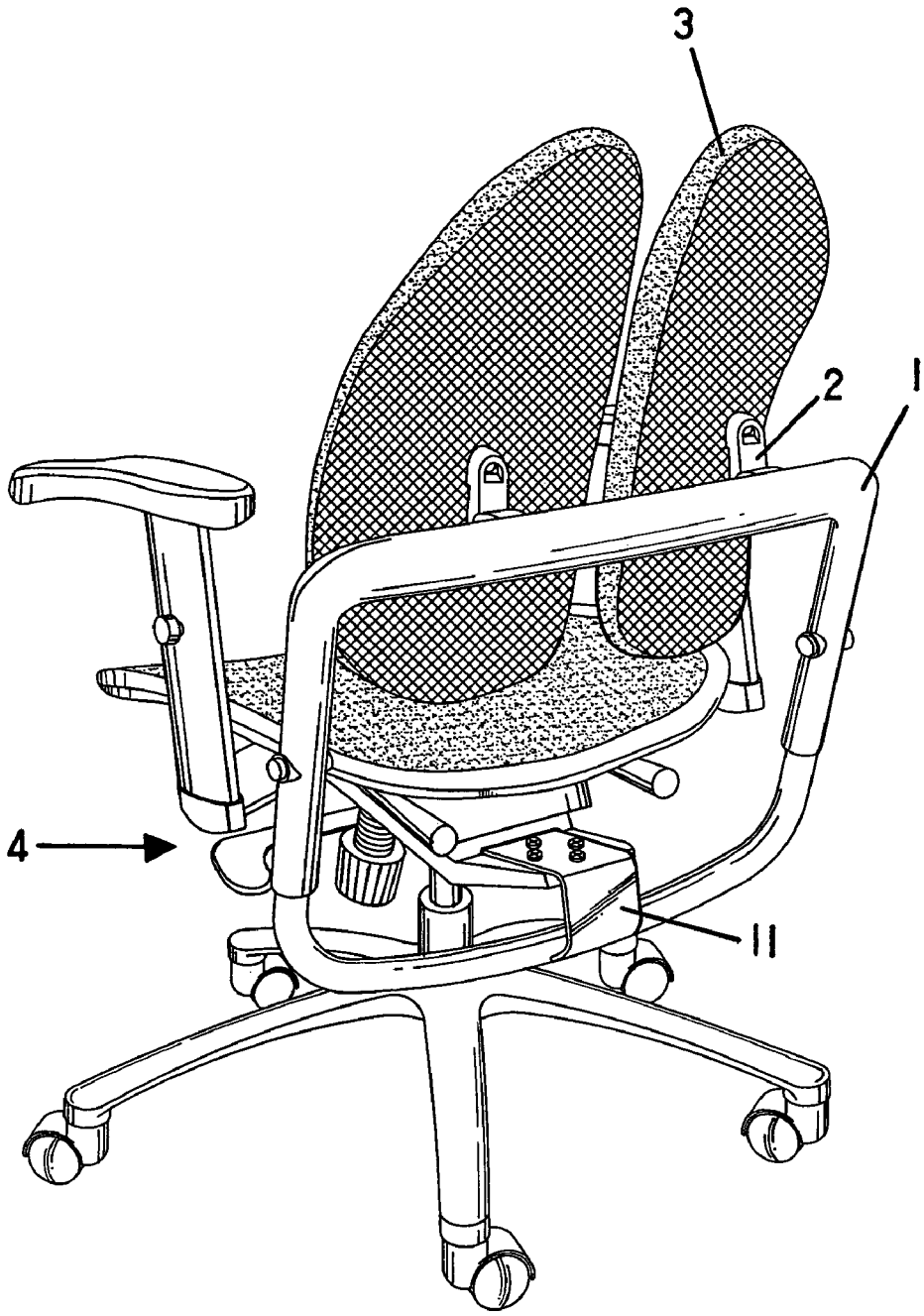
FIG. 1 is a perspective view of a movable backrest for a chair in accordance with the present invention.
Figure 2:
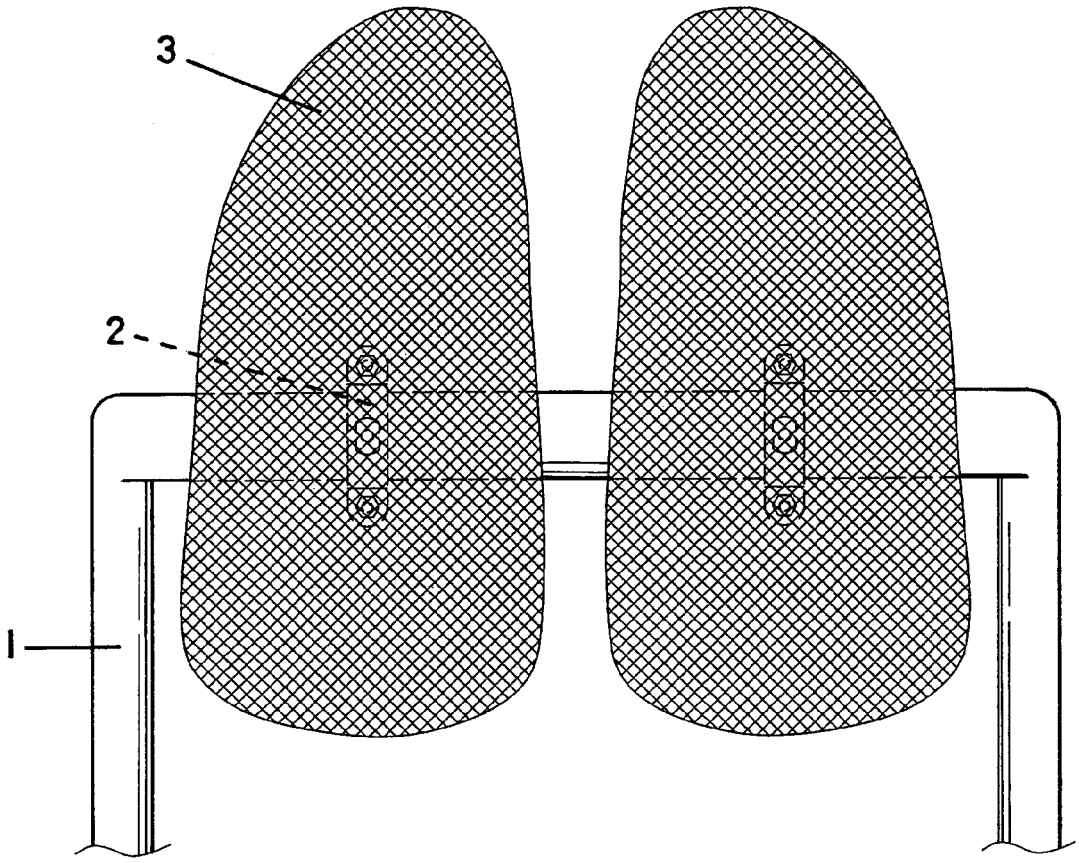
FIG. 2 is a plane view of the movable backrest for a chair in accordance with the present invention.
Figure 3:
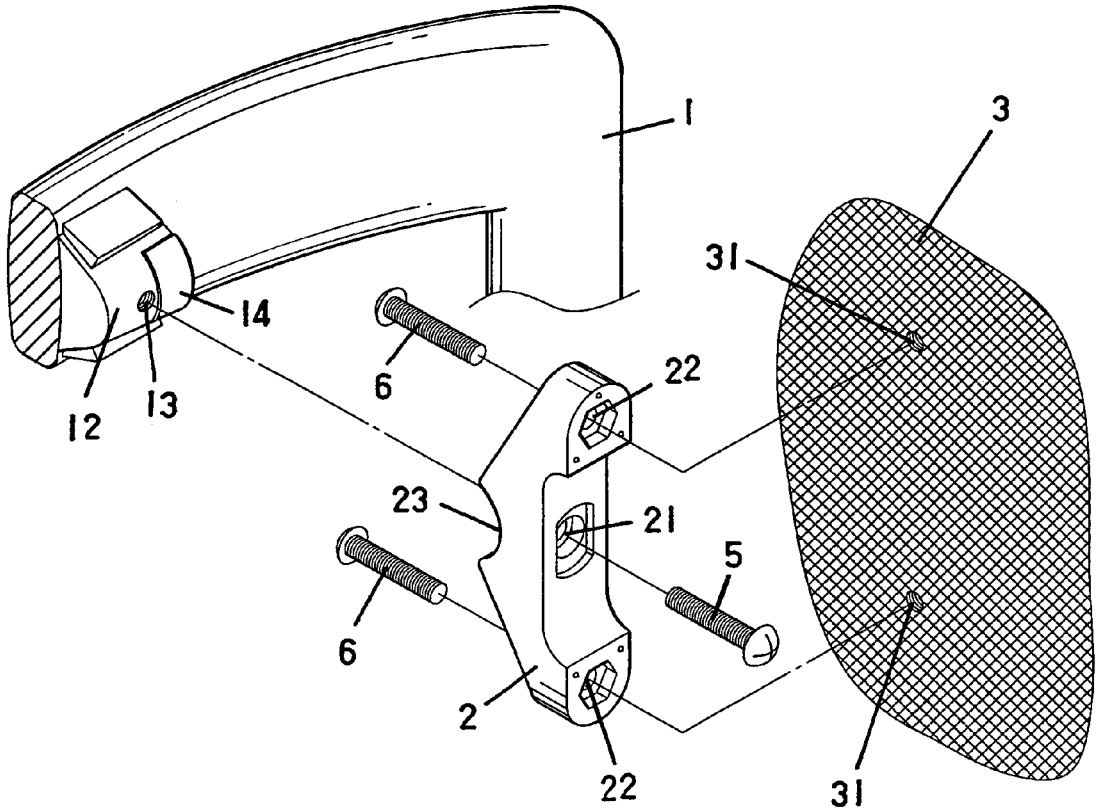
FIG. 3 is an exploded view of the movable backrest for a chair in accordance with the present invention.
Figure 4:
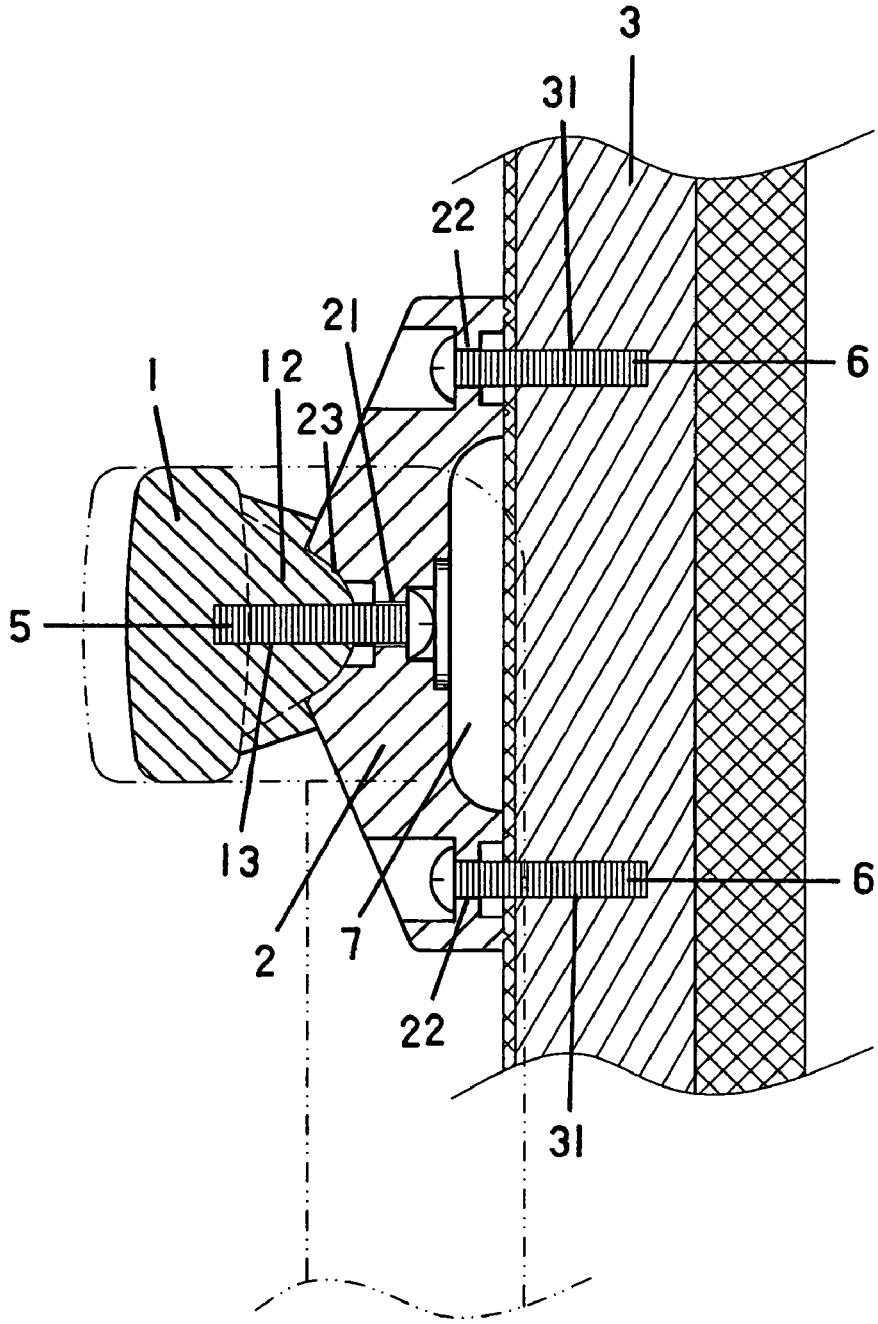
FIG. 4 is an assembly cross sectional view of the movable backrest for a chair in accordance with the present invention.
Figure 5:
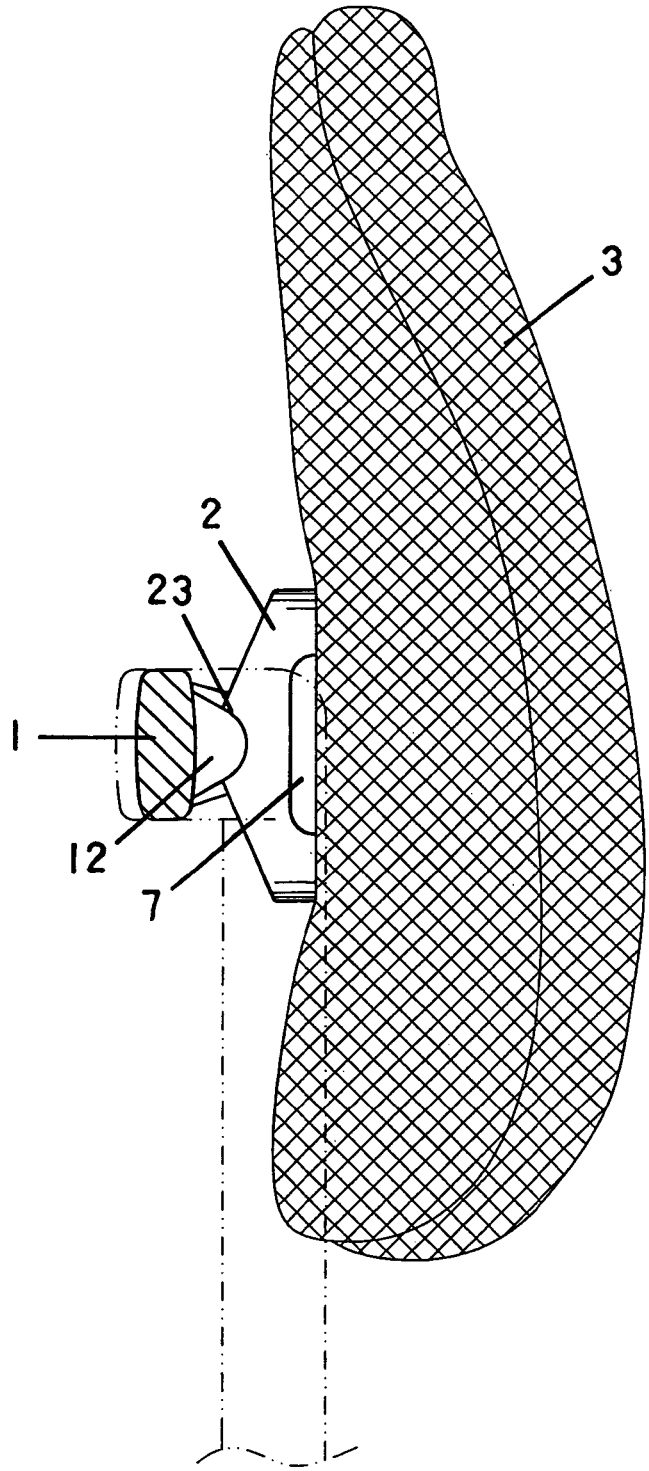
FIG. 5 is an assembly plane view of the movable backrest for a chair in accordance with the present invention.

Referring to FIGS. 1-3, a movable backrest for a chair in accordance with the present invention comprises a frame 1, at least a connecting element 2 and at least a backrest 3. On the frame 1 is a mounting 11 for connecting to a chair 4, and at least a protruded portion 12 with a first threaded hole 13 is formed on the top of the frame 1. In one embodiment of the present invention, the mounting 11 is a plate adapted for connecting to a chair 4. In another embodiment of the present invention, the protruded portion 12 is attached to or formed of the frame 1, and in a further embodiment a flange 14 is formed on the protruded portion 12. The connecting element 2 is flexible and is made of rubber, plastic, silica gel or other flexible material, and includes a first aperture 21, two second apertures 22 and a concave portion 23. In one preferred embodiment, the connecting element 2 is basically planar having a generally chevron-shape, as illustrated in FIG. 3. The concave portion 23 is engaged with the protruded portion 12, and a bolt 5 is inserted into the first threaded hole 13 via the first aperture 21, thereby the connecting element 2 is connected to the frame 1. The backrest 3 includes two second threaded holes 31, two second bolts 6 are inserted into the second threaded holes 31 via the second apertures 22, thus the backrest 3 is connected to the connecting element 2, and a space 7 is formed in a middle portion of an edge of the connecting element 2 to provide a separation between the backrest 3 and the connecting element 2 (as shown in FIGS. 4 and 5).

Figure 6:
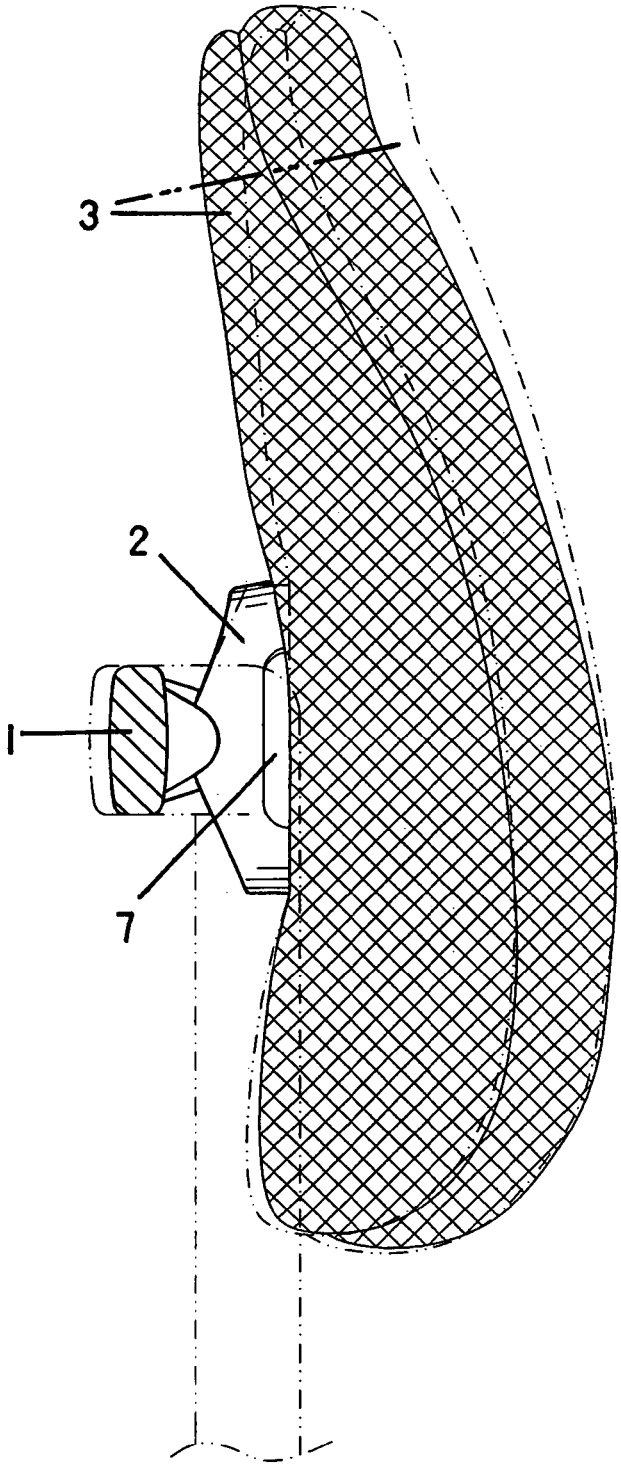
FIGS. 6 and 7 are perspective views of showing the up and down moving of a backrest of the present invention.
Figure 7:
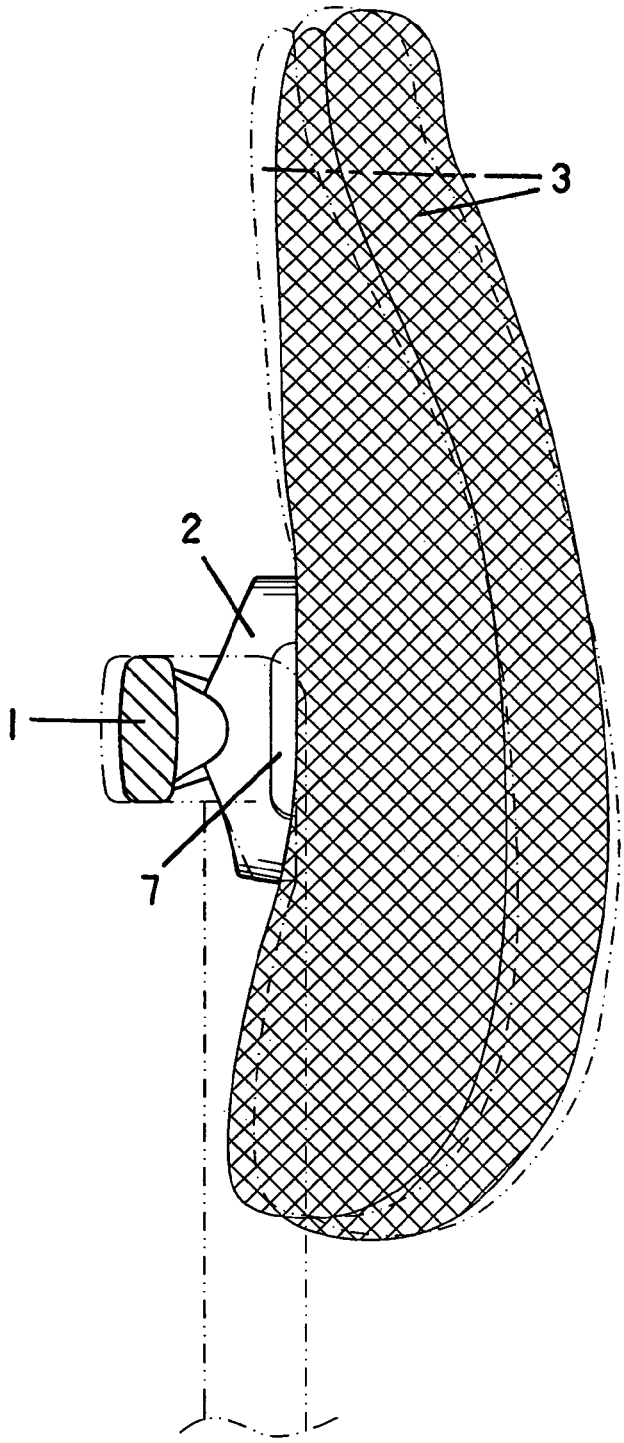
Figure 8:
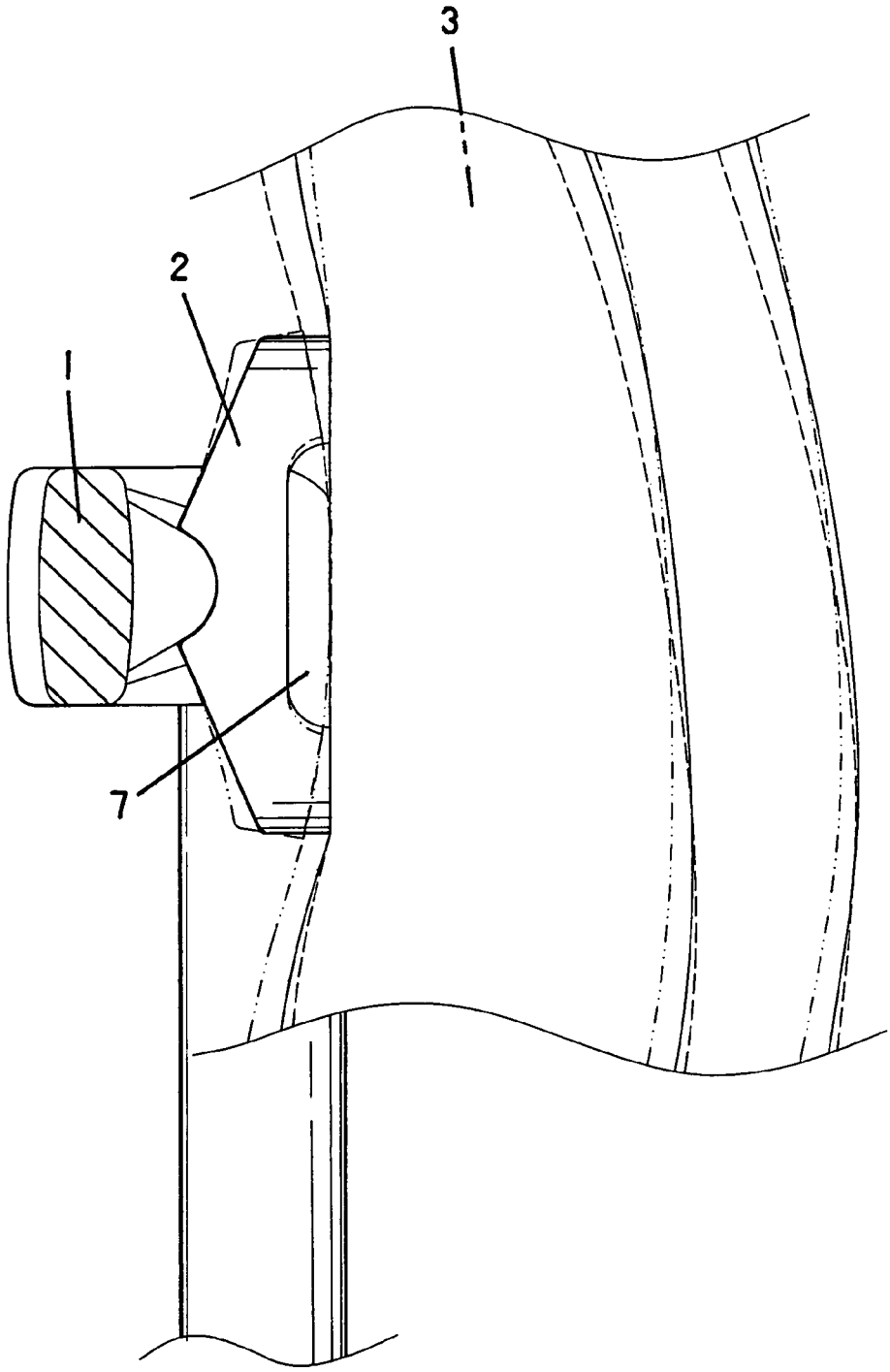
FIG. 8 is another perspective view of showing the left and right moving of the backrest of the present invention.

When the user sits on the chair 4, the back of the user is abutted against the backrest 3, since the connecting element 2 is flexible, the backrest 3 and the connecting element 2 will be moved simultaneously along with the movement of the back of the user, providing a comfortable support to the back of the user (as shown in FIGS. 6-8), so the user will feel comfortable.

Since at least a backrest 3 is movable, the back of the user can be abutted against the backrest 3 firmly, the back of the user is supported by the backrest 3 totally, and then the user will feel more comfortable.

The space 7 is provided for increasing the flexibility of the connecting element 2.

The flange 14 disposed on the outer side of the protruded portion 12 enables the backrest 3 to face inwardly on the chair 4.

In addition to the use of threads, the frame 1, the connecting element 2, and the backrest 3 can also be secured to one another by the use of gluing, riveting, or other methods.

While we have shown and described various embodiments in accordance with the present invention, it should be clear to those skilled in the art that further embodiments may be made without departing from the scope of the present invention.

What is claimed is:

1. A movable backrest for a chair, comprising:

at least a backrest;

at least a flexible connecting element having a first side with a concave portion, and a second side connected to the backrest; and a frame having at least a protruded portion formed thereon, the protruded portion being adapted to engage with the concave portion of the connecting element, the frame having a mounting for fixing to a chair;

wherein the second side of the connecting element is divided with a space being formed at a middle portion thereof, providing a separation between the middle portion of the connecting element and the backrest, thereby increasing the flexibility of the connecting element.

2. The movable backrest for a chair as claimed in claim 1, wherein the connecting element is essentially planar having a generally chevron-shape, with the concave portion located at an apex of the chevron-shape and an open end of the chevron-shape forming the divided second side of the connecting element.

3. The movable backrest for a chair as claimed in claim 1, wherein a flange is formed on the outer side of the protruded portion of the frame, thereby enabling the backrest to face in an inwardly direction on the chair.

* * * * *